US005168315A

United States Patent [19]

Osawa et al.

[11] Patent Number: 5,168,315

[45] Date of Patent: Dec. 1, 1992

[54] IMAGE FORMING METHOD FOR FORMING IMAGES ON COPIER PAPER HAVING A SPECIFIC CONSTRUCTION USING A TONER HAVING A SPECIFIC PARTICLE DIAMETER AND AN IMAGE FORMING DEVICE WHICH USES SAID TONER AND COPIER PAPER

[75] Inventors: Izumi Osawa, Ikeda; Eiichi Sano, Takatsuki; Shuji Iino, Hirakata, all of Japan

[73] Assignee: Minolta Camera Kabushiki Kaisha, Osaka, Japan

[21] Appl. No.: 615,273

[22] Filed: Nov. 19, 1990

[30] Foreign Application Priority Data

Nov. 20, 1989 [JP] Japan ..... 1-301514

[51] Int. Cl.[5] ..... G03G 15/20

[52] U.S. Cl. ..... 355/290; 355/282

[58] Field of Search ..... 355/282, 290, 295, 245

[56] References Cited

U.S. PATENT DOCUMENTS 4,949,130 8/1990 Torino ..... 355/282

5,041,718 8/1991 d'Hondt et al. ..... 219/255

*Primary Examiner*—Richard L. Moses

*Attorney, Agent, or Firm*—Burns, Doane, Swecker & Mathis

[57] ABSTRACT

The present invention relates to method and apparatus for processing a fused toner image onto paper by using toner having a predetermined mean particle size and paper having a specialized surface roughness so as to improve the fused strength of the toner and image quality.

4 Claims, 3 Drawing Sheets

IMAGE FORMING METHOD FOR FORMING IMAGES ON COPIER PAPER HAVING A SPECIFIC CONSTRUCTION USING A TONER HAVING A SPECIFIC PARTICLE DIAMETER AND AN IMAGE FORMING DEVICE WHICH USES SAID TONER AND COPIER PAPER

BACKGROUND OF THE INVENTION

1. Field of the Invention

The present invention relates to an image forming method and image forming device for forming a toner image on copier paper having a specific construction using toner particles having a specific particle diameter.

More specifically, the present invention relates to an image forming method and image forming device, for example, a copying machine, printer, facsimile and the like, for adhering by either heat or pressure toner particles having a specific particle diameter on copier paper having a specific construction to produce a toner image.

2. Description of the Prior Art

In the field of image forming devices used in copying machines and the like, there have been many recent proposals for producing small diameter toner particles to obtain high quality images.

When the aforesaid small diameter toner particles are adhered to copying paper, however, the adhered toner image does not produce the expected image quality nor does said toner adequately adhere to the surface of the copying paper despite the use of the small diameter toner particles.

SUMMARY OF THE INVENTION

An object of the present invention is to provide and image forming method and an image forming device that eliminates the previously described disadvantages.

More specifically, an object of the present invention is to provide an image forming method and image forming device that produces high-quality images while at the same time preventing unsatisfactory adhesion by using a dry-type toner having a volumetric means particle diameter of 6–8 μm and using copy paper having specific characteristics of surface roughness.

The aforesaid objects of the present invention are accomplished by an image forming method and image forming device described hereinafter.

That is, the present invention is an image forming method including a process for forming a toner image on copy paper using a dry-type toner having a mean volumetric particle size of 6 to 8 μm and a process for fixing a said toner image on the copy paper, said image forming process being characterized by using copy paper having a surface roughness of 13 μm or less (measured length: 2.5 mm) at ten-point mean roughness measured by the JIS-B0601 measuring method.

Further, the present invention is an image forming method for an image forming device including a means for forming a toner image on copy paper using a dry-type toner having a volumetric means particle diameter of 6 to 8 μm and a means for fixing said toner image to the copy paper, said image forming method being characterized by using copy paper having a surface roughness of 13 μm or less (measured length: 2.5 mm) at ten-point means roughness measured by the JIS-B0601 measuring method.

These and other objects, advantages and features of the invention will become apparent from the following description thereof taken in conjunction with the accompanying drawings which illustrate specific embodiments of the invention.

BRIEF DESCRIPTION OF THE DRAWINGS

In the following description, like parts are designated by like reference numbers throughout the several drawings.

DETAILED DESCRIPTION OF THE INVENTION

The present invention comprises toner having a small particle diameter and including a resin and wax or other organic macromolecular constituents, to wit, toner particles having a volumetric mean particle diameter of 6 to 8 μm which is fixed to a copy paper by heat, pressure or the like, the adhesion properties of the obtained toner image or the reproducibility of the image being greatly dependent upon the structure of the copy paper. More specifically, the present invention comprises a method for obtaining a toner image having excellent adhesion qualities and image reproduction by means of a combination of copy paper having a ten-point mean roughness of 5 to 13 μm and the aforesaid toner having a volumetric mean particle diameter of 6 to 8 μm.

The copy paper in the present invention comprises a manufactured flat sheet of interlocking innumerable vegetable fibers, viscose rayon, cellulose acetate, and synthetic fibers, with numerous air spaces in its interior portion. The volumetric mean particle diameter of the toner particles produces adhesion of individual toner particles having a particle diameter of d, such that $$\sqrt[3]{\frac{\Sigma(nd^3)}{\Sigma n}}$$

Further, the ten-point mean roughness indicates a ten-point roughness conforming to the JIS-B0601 measurement method. That is, the ten-point mean roughness expresses in micrometers (μm) the difference between a mean value for the elevation from the maximum depth to the fifth greatest depth and a mean value for the peak elevation from a maximum height to the fifth greatest height measured parallel to a mean line, to wit, in the longitudinal magnification direction from a straight line that does not intersect a section curve, in a portion removed from the section curve a standard length only.

Figure 1:
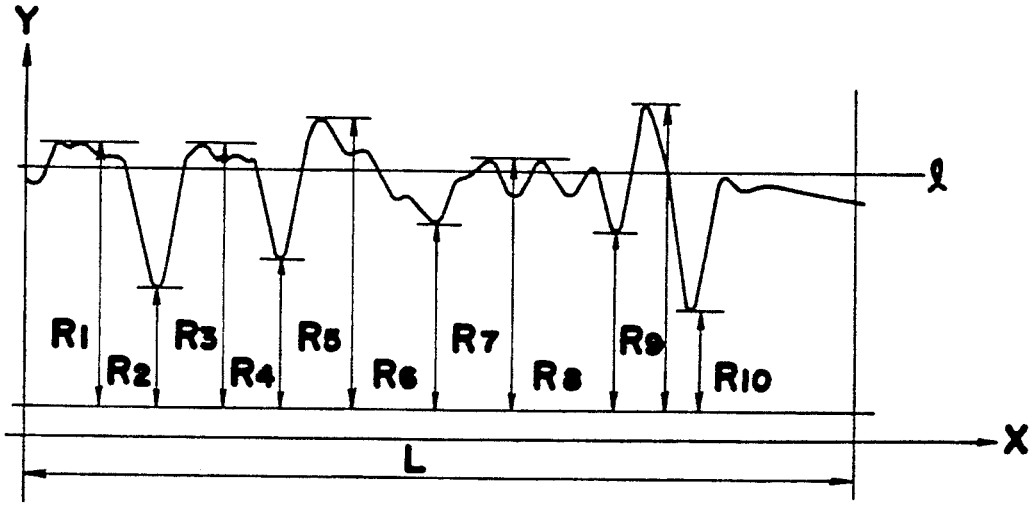
FIG. 1 is an illustration showing the definition of ten-point means roughness of the present invention.

In FIG. 1, L is the standard length and l is the mean line. In the drawing, Y indicates the longitudinal magnification direction, and X indicates the recording direction of ten-point roughness. Also in the drawing, R1, R3, R5, R7 and R9 express peak elevations from the maximum height to the fifth greatest height in an extracted portion of standard length L, and R2, R4, R6, R8 and R10 express the valley elevation from the maximum depth to the fifth greatest depth in an extracted portion of standard length L. Ten-point roughness (Rz) is defined by the following equation:

$$Rz=[(R1+R3+R5+R7+R9)-(R2+R4+R6+R8+R10)]/5$$

The ten-point mean roughness of the present invention is a value obtained from measurements taken on a sample of standard length L, to wit, 2.5 mm in length.

A more detailed description of the toner of the present invention follows hereinafter in relation to the excellent toner image reproducibility and adhesion properties after numerous trials in which said toner was used in combination with the previously described copy paper.

The copy paper previously described has a structure of innumerable interlocking fibers and is formed so as to have numerous air spaces in its interior portion. When a toner image is fixed to the copy paper and the ten-point surface roughness of said copy paper is fine relative to the particle diameter of the toner, the toner does not penetrate to the interior portion of the copy paper and is displaced on the surface of said copy paper during the fixing process and fused in place by heat or pressure applied by a fixing roller or oven fixing device. Thus, toner that does not penetrate to the interior portion of the copy paper rises above the surface of the copy paper such that the fixed toner image is not sharp; for example, even if a small particle diameter toner is used, not only is toner image reproducibility not objectively improved, but to the contrary, image resolution characteristics are markedly reduced.

Examples of copy paper having the previously mentioned fine ten-point roughness are resin-coated copy paper, glossy finish copy paper, and OHP resin film that lacks a paper-like structure.

For the aforesaid reasons, in order to improve toner image reproducibility the toner must not aggregate on the surface of the copy paper.

The present invention can prevent aggregation of the toner by providing copy paper having a surface roughness of 5 μm or greater relative to the toner which has a volumetric mean particle diameter of 5 to 8 μm.

On the other hand, when the ten-point roughness of the copy paper is rough relative to the toner particle diameter, the toner penetrates excessively into the interior portion of said copy paper, and during the fixing process the adiabatic effect of the air spaces in the interior portion of the copy paper is rendered ineffective, thereby causing inadequate fixing so that the toner which penetrates into the interior portion of the copy paper does not fuse causing black smudging when the surface of the copy paper is touched after the copying process. That is, the unfused toner emerges from the surface of the copy paper to soil the surface thereof.

Accordingly, in order to improve inadequate fusion, the toner must not penetrate into the interior portion of the copy paper.

The present invention can prevent toner penetration so as to produce the effect of preventing inadequate fusion of said toner by providing copy paper having a surface roughness of 13 μm or less relative to a toner having a volumetric means particle diameter of 6 to 8 μm.

Properties of the copy paper used in the present invention include a ten-point roughness of 5 to 13 μm with an air space percentage of 45 to 55%. When the air space percentage is less than 45%, the internal structure of the copy paper becomes overly dense; for example, there is concern that, even if the ten-point mean roughness is greater than 5 μm, the toner will not penetrate into the interior of the copy paper depending on the fixing conditions. On the other hand, when the air space percentage is in excess of 55%, the structure of the copy paper becomes overly thin; for example, there is concern that, even if the ten-point roughness is less than 13 μm, the toner will excessively penetrate into the interior portion of the copy paper leading to unfused toner depending on the fixing conditions. The aforesaid air space percentage is defined by the following equation:

$$\text{Air space } \% = \{1-(\text{weight density of said copy paper})/(\text{the intrinsic weight density of the material of said copy paper})\} \times 100$$

The copy paper used in the present invention is preferably not very glossy so as to make the fixed toner more readily visible. Although the ten-point mean roughness and the degree of glossiness need not necessarily be proportional, in general, the sense of naturalness is lost as roughness is reduced and glossiness is excessive. Since the ten-point mean roughness of the copy paper of the present invention is relatively small, the glossiness is preferably about 15% or less. The aforesaid glossiness is defined by the following equation:

$$\text{Glossiness } \% = \{(\text{intensity of luminous flux reflected from sample surface})/(\text{intensity of luminous flux entering sample surface})\} \times 100$$

Further, there is a tendency for glossiness to increase after fixing when pressure is used to accomplish the fixing process. Accordingly, it is desirable that the ten-point mean roughness of the copy paper of the present invention be 9 μm or more prior to fixing.

Although not directly related to fusibility, copy paper having a ten-point mean roughness that is excessively fine has unreliable transportability within the image forming device of the copying machine or the like which handles said copy paper. That is, the copy paper must possess a certain degree of roughness because said copy paper is transported within the aforesaid devices by means of frictional resistance produced between said copy paper and the transporting members of the devices. More specifically, copy paper having a ten-point mean roughness of 7 μm or greater is desirable from the perspective of transportability.

Further, a combination of heating and pressure may be used in the fixing process in the present invention. When the combination of heat fixing and pressure fixing is used, a copy paper having a ten-point mean roughness of 5 to 13 μm is desirable in addition to said copy paper possessing a certain degree of thermal conductivity so as to prevent toner non-fusion in the interior portion of the copy paper as previously described. More specifically, a coefficient of thermal conductivity of about 0.1 to 0.3 W/m·K is desirable. In the case of copy paper having a coefficient of thermal conductivity of about 0.1 to 0.3 W/m·K, a thermal quantity of about 0.3 to 0.7 Joules/cm$^2$ and a pressure of about 150 to 450 gram-weight/cm$^2$ are applied to the copy paper, so as to prevent excessive increase in the degree of glossiness and change in properties due to the heat applied to the copy paper. On the other hand, the physical properties of a toner suitable for the aforesaid fixing conditions are a combination of a softening point at 80°–150° C., a number-average molecular weight Mn of 3,000 to 20,000, and a melt viscosity of $10^8$ to $10^7$ cps. Examples of useful materials for the main components of the aforesaid toner are thermoplastic resins such as polyester, styrene, silicon, wax and the like. The aforesaid toner may include magnetic material, electric charge regulating material, depending on requirements, as well as silica or similar flow-enhancing material.

Although the present invention has been fully described by way of embodiments with reference to the accompanying drawings as follows, it is to be noted that various changes and modifications will be apparent to those skilled in the art. Therefore, unless such changes and modifications depart from the scope of the present invention, they should be construed as being contained therein.

Figure 2:
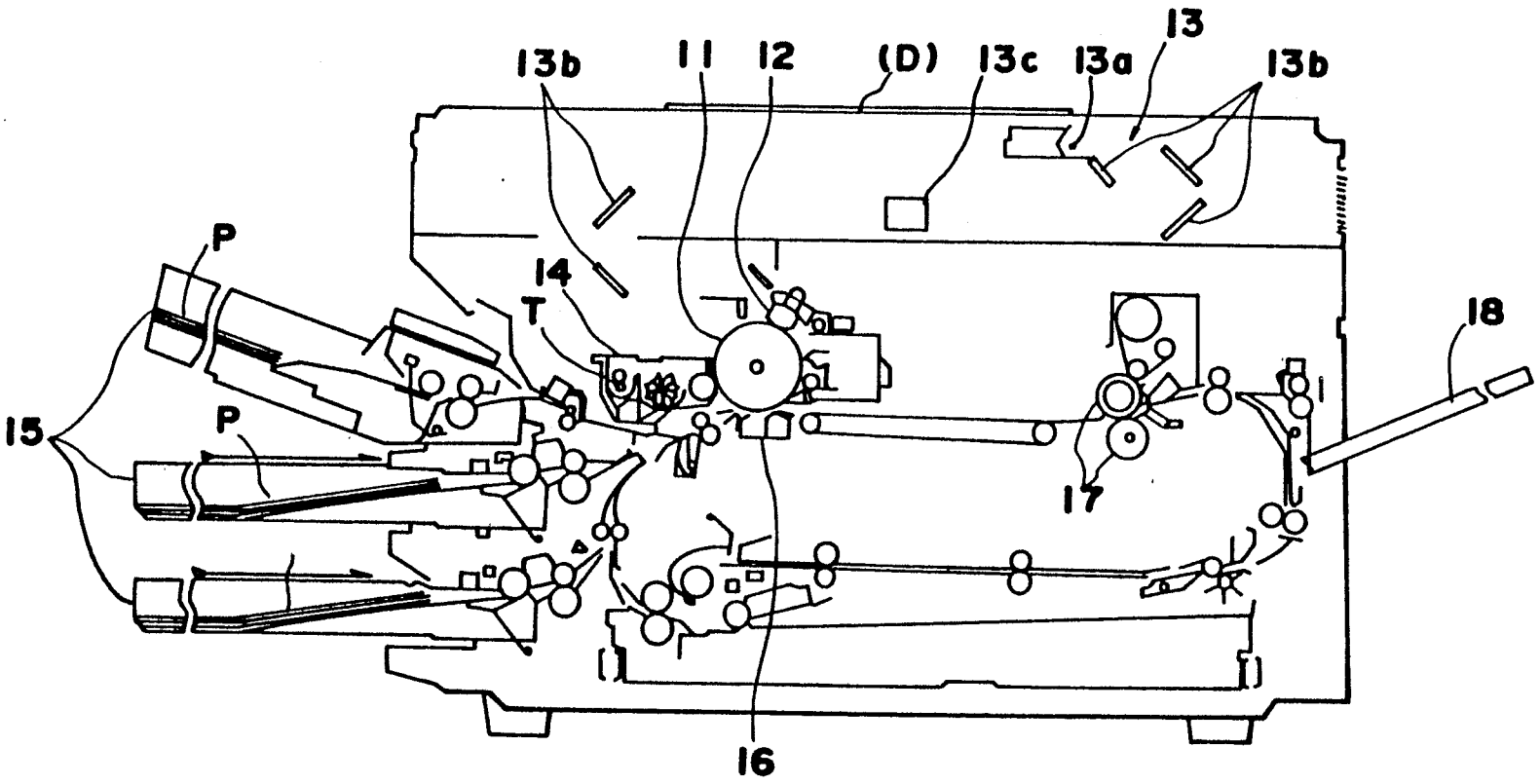
FIG. 2 is a brief cross section view showing an embodiment of the copying machine of the present invention.

FIG. 2 shows a copying machine 1 which uses a toner and a copying paper of the present invention. A simple description of the copying machine 1 follows hereinafter.

In the main unit 1, a photoconductive member 11 is rotatably driven, and the surface of said rotatably driven photoconductive member 11 is electrically charged by a main charger 12, then original document D is scanned by an exposure means comprising an exposure lamp 13*a*, mirrors 13*b* and lens 13*c*, and the scanned image of the aforesaid original document D is exposed on the surface of the charged photoconductive member 11 so as to form an electrostatic latent image thereon.

Next, toner is supplied from a developing device 14 to the surface of the photoconductive member 11 upon which is formed the previously described electrostatic latent image so as to form a toner image on the surface thereof, and said toner image formed on the surface of the photoconductive member 11 is then transferred onto a copy paper P supplied from a paper cassette 15 by means of a charger 16 which electrically charges the reverse surface of the copy paper with an electrical charge having an opposite polarity to that of the toner. The transferred toner image is then fused to the copy paper by a thermal fixing roller 17, and the copy paper is discharged to a discharge tray 18. The fixing roller 17 is set so as to apply to the copy paper P a pressure of 300 gram-weight/cm$^2$ and a heat quantity of 0.5 W/cm$^2$.

In the present embodiment, a toner T is produced under the following conditions (pbw: parts-by-weight).

| | |
|---|---|
| Styrene-acrylic resin (softening point 132° C., glass transition point 62° C.) | 100 pbw |
| Carbon black MA #8 (Mitsubishi Chemical Industries. Ltd.) | 5 pbw |
| Charge regulator nigrosine base EX (Orient Kagaku K.K.) | 5 pbw |

The aforesaid materials were adequately mixed using a Henschel mill, and the obtained mixture was kneaded in a biaxial extruder, cooled, then course ground. The ground material was grind-classified using a jet grinder and forced-air classifying device, then the classification points were changed to obtain toners having volumetric mean particle diameters shown in Table 1.

The softening point, number-average molecular weight, and melt viscosity for each of the toners were 132° C,, 10,000 and $2\times10^6$ cps', respectively.

TABLE 1

| Toner No. | Volumetric Mean Particle Diameter |
|---|---|
| T1 | 6 μm |
| T2 | 7 μm |
| T3 | 8 μm |

The volumetric mean particle diameters shown in Table 1 were measured using a particle size distribution measuring device model SALD-1100 (Shimadzu Seisakusho, K. K.).

The toners obtained in the previously described manner were combined with binder resin and carrier particles comprising a magnetic powder, and were then accommodated in the developing device 14 as positive-charged toner.

Using the toners shown in Table 1, toner images were formed on the copy papers shown in Table 2 and fused thereon by means of the fixing device 17. A test chart having an image density of 1.20, character size of 1×1 mm, and character ratio of 50% was used as the original document D.

TABLE 2

| Paper No. | Surface Roughness | Mean Weight | Air Space % | Thermal Conductivity |
|---|---|---|---|---|
| P1 | 4 μm | 120 g/m$^2$ | 55% | 0.22 W/m · K |
| P2 | 5 μm | 104 g/m$^2$ | 54% | 0.22 W/m · K |
| P3 | 6 μm | 104 g/m$^2$ | 52% | 0.21 W/m · K |
| P4 | 7 μm | 85 g/m$^2$ | 51% | 0.20 W/m · K |
| P5 | 9 μm | 80 g/m$^2$ | 49% | 0.20 W/m · K |
| P6 | 12 μm | 80 g/m$^2$ | 47% | 0.20 W/m · K |
| P7 | 13 μm | 75 g/m$^2$ | 46% | 0.19 W/m · K |
| P8 | 14 μm | 64 g/m$^2$ | 45% | 0.19 W/m · K |

The ten-point mean surface roughness shown in Table 2 was measured on sample stripes 2.5 mm in length using a surface roughness measuring device model Saakomu 550A (Tokyo Mitsudosei K. K.) (contact-wire type roughness meter using a diamond wire).

The obtained toner images were evaluated for toner fusing characteristics and image reproducibility. The evaluation results are shown in Table 3.

TABLE 3

| | Toner No. | | | | | |
|---|---|---|---|---|---|---|
| | Fusing Characteristics | | | Image Reproducibility | | |
| Paper No. | T1 | T2 | T3 | T1 | T2 | T3 |
| P1 | A | A | A | A | B | B |
| P2 | A | A | A | A | A | A |
| P3 | A | A | A | A | A | A |
| P4 | A | A | A | A | A | A |
| P5 | A | A | A | A | A | A |
| P6 | A | A | A | A | A | A |
| P7 | B | B | A | A | A | A |
| P8 | C | C | B | A | A | A |

A more specific description of the evaluation results for fusing characteristics and image reproducibility follows hereinafter.

Figure 3A:
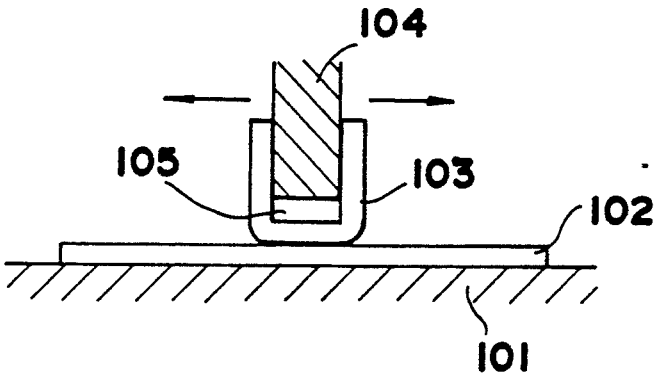
FIG. 3A and 3B show the devices for measuring the adhesion of toner images obtained from the embodiments of the present invention and comparative examples.
Figure 3B:
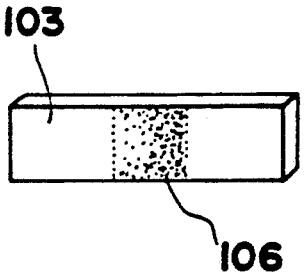

First, fusing characteristics were evaluated in the manner shown in FIG. 3A. Item 102 in FIG. 3A is a sample of the copy paper on which is fixed the toner according to the combinations shown in Table 3. A glass plate 101 was fixedly mounted on top of the recording surface of the aforesaid sample 102. A load-applying head 104 comprises a metal rod having a square shaped tip measuring 10×10 mm with felt glued to the tip surface thereof, and applies a pressure of 1 kg/cm² by means of its own weight and overlay, (not shown in the drawing) in the direction of the glass plate 101 while moving reciprocatingly in the arrow direction by means of a mechanism not shown in the drawing. Unused normal paper 103 is mounted so as to cover the aforesaid tip surface, and the recording surface of the sample 102 is rubbed while the tip of the head 104 moves reciprocatingly and toner is rubbed from the recording surface by the rubbing movement of the normal paper 103, thereby producing a black smudge 106, as shown in FIG. 3B. The image density of the aforesaid smudge 106 was measured to determine the rubbing strength, to wit, the fixing characteristics, parameters. The number of reciprocating motions of the load-applying head 104 was preset at 20 strokes so as to produce a suitable smudge.

The previously described smudge 106 was scanned using a density measuring device (Sakura microdensitometer model PDM-5 type BR (Konishiroku Photo Industry Co., Ltd.) with a slit width of 2.5 mm, slit height of 20 mm, X-axis scan speed of 500 μm/second, and a Y-axis travel width of 500 μm, and the minimum density rankings were labeled A, B and C, as shown in Table 3.

A rank: Density 0.08 or less; excellent fusion; most suitable.

B rank: Density over 0.08 to 0.12; unsatisfactory toner fusion was slight; no problems in practical application; suitable.

C rank: Density over 0.12; unsatisfactory fusion observed; unsuitable.

A description of the image reproducibility evaluation follows hereinafter. Visual inspection of character sharpness was evaluated by A, B and C ranking, as shown in Table 3.

A rank: Fixed toner image characters have sharp peripheries; no ragged dispersion was observed.

B rank: Fixed toner image characters have unsharp peripheries; characters are somewhat raised.

It can be readily understood from the evaluation results shown in Table 3 that, from the perspective of fusion characteristics, the surface roughness of copy paper P is preferably 13 μm or less, and from the perspective of image reproducibility said surface roughness is preferably 5 μm or greater.

When 10,000 copy images were produced continuously using each of the copy paper and toner combinations shown in Table 3, paper supplying problems occurred with the copying machine 1 when the surface roughness of said copy paper was less than 7 μm, but no such problem was evident when surface roughness of the copy paper was 7 μm or greater (to wit, copy papers P1, P2, P3). Further, when the degree of glossiness of the non-character printed portion was measured after the toner image was fixed, it was found that glossiness was raised 15% on copy paper having a surface roughness of less than 9 μm (to wit, copy papers P1 through P4) with some attendant loss of naturalness.

What is claimed is:

1. An image forming device for forming a toner image onto copy paper comprising:

means for depositing toner particles onto copy paper, said toner particles having a volumetric mean particle diameter of 6 to 8 micrometers, and said paper having a surface roughness with convex-like elevations relative to the depths on its surface and having a ten-point surface roughness (Rz) of 5 to 13 micrometers, wherein said ten-point surface roughness (Rz) is defined by the following equation:

$$Rz-[(R1+R3+R5+R7+R9)-(R2+R4+R6+R8+R10)]/5$$

wherein R1, R3, R5, R7 and R9 express peak elevations from the maximum height to the fifth greatest height of the extracted portions with a standard length (L) of 2.5 mm, said standard length (L) defining a distance from one point to another point on the surface of the paper as measured straight, and R2, R4, R6, R8 and R10 express valley elevations from the maximum depth to the fifth greatest depth within said standard length (L) or 2.5 mm; and means for fixing said deposited toner particles onto the copy paper.

2. The image forming device as claimed in claim 1, wherein said fixing means comprises:

means for pressuring the deposited toner particles to the surface of the copy paper; and means for heating a pressure member to fuse the toner particles thereby fixing the toner particles onto the copy paper.

3. The image forming device as claimed in claim 2, wherein said pressure means pressures said deposited toner particles onto the copy paper with 150–450 gram-weight/cm² and said heating means heats said deposited toner particles with 0.3–0.7 joules/cm².

4. An image forming device for forming a toner image onto copy paper comprising:

means for forming an electrostatic latent image with toner particles having a volumetric mean particle diameter of 6 to 8 micrometers on an image bearing member;

means for developing said electrostatic latent image;

means for transferring said developed toner particles from the image bearing member to copy paper, said copy paper having a surface roughness with convex-like elevations relative to the depths on its surface and having a ten-point surface roughness (Rz) of 5 to 13 micrometers, wherein said ten-point surface roughness is defined by the following equation:

$$Rz-[(R1+R3+R5+R7+R9)-(R2+R4+R6+R8+R10)]/5$$

wherein R1, R3, R5, R7 and R9 express peak elevations from the maximum height to the fifth greatest height of the extracted portions within a standard length (L) of 2.5 mm, said standard length (L) defining a distance from one point to another point on the surface of the paper as measured straight, and R2, R4, R6, R8 and R10 express valley elevations from the maximum depth to the fifth greatest depth within said standard length (L) of 2.5 mm;

means for pressuring the transferred toner particles to the surface of the paper; and means for heating a pressure member to fuse the toner particles thereby fixing said toner particles onto the copy paper.

* * * * *